United States Patent [19]

Hopkins et al.

[11] 4,037,559

[45] July 26, 1977

[54] MILK REQUIREMENT INDICATOR

[76] Inventors: John Leslie Hopkins, 8 Carrwood Road, Bramhall, Stockport; Arthur Holmes, Rombald, 25 Ryburn Ave., Blackburn, Lancashire, both of England

[21] Appl. No.: 645,669

[22] Filed: Dec. 31, 1975

[30] Foreign Application Priority Data

Jan. 11, 1975 United Kingdom ..... 1238/75

[51] Int. Cl.[2] ..... G09F 9/00

[52] U.S. Cl. ..... 116/133; 40/311

[58] Field of Search ..... 116/133, 121, 130, 114 R; 215/365; 40/310, 311

[56] References Cited

U.S. PATENT DOCUMENTS

| | | | |
|---|---|---|---|
| 2,031,291 | 2/1936 | Wahlin | 116/133 |
| 2,706,464 | 4/1955 | North | 116/121 |
| 3,818,858 | 6/1974 | Kramer | 116/133 |

FOREIGN PATENT DOCUMENTS

| | | | |
|---|---|---|---|
| 109,313 | 12/1939 | Australia | 116/133 |

*Primary Examiner*—S. Clement Swisher
*Assistant Examiner*—Denis E. Corr
*Attorney, Agent, or Firm*—Pearson & Pearson

[57] ABSTRACT

An indicator device for use in connection with milk bottles as a means of indicating a requirement therefor consists of two telescopingly and separably engaged conical members rotatably supported one upon another, and co-operating scale and pointer means on the respective parts adapted, according to a relative angular disposition, to indicate a selected one of a plurality of legends which constitute the scale.

10 Claims, 2 Drawing Figures

MILK REQUIREMENT INDICATOR

The invention concerns indicators and has particular reference to an indicator device for use in connection with milk bottles for indicating the quantity required to be delivered.

Various forms of indicators are used for making known the quantity of milk, or other products, required by a customer. Thus, for example, an indicator is known which comprises two relatively rotatable concentric discs of which the uppermost has an aperture therein thus to make visible a selected one of a plurality of numbers provided adjacent the periphery of a face of the lowermost disc, the number selected being that appropriate to the number of units, usually pints, of milk required by the customer. Another form of indicator comprises a clock-face type scale having an arrow arranged concentrically therewith, the structure usually being embodied with a container, in the form of a small crate, intended to receive the bottles.

The object of the present invention is to provide an alternative indicator device to those presently available which will fulfil a function additional to its primary function of indicating.

According to the present invention we propose an indicator device, primarily for use in connection with milk bottles as a means for ordering further quantities thereof, comprising a sleeve-like member dimensioned for engagement with a bottle top, and cooperable indicator means on the sleeve-like member and on a part movably mounted on such member, the cooperable indicator means being adapted for indicating a selected one of a plurality of legends provided by the said indicator means.

According to a preferred feature the movably mounted part comprises a further sleeve-like member telescopingly engageable with the first such member in coaxial relationship therewith.

According to another feature, the further sleeve-like member is freely removable from the first such member.

Preferably the or each sleeve-like member has a closed upper end thereto.

Figure 1:
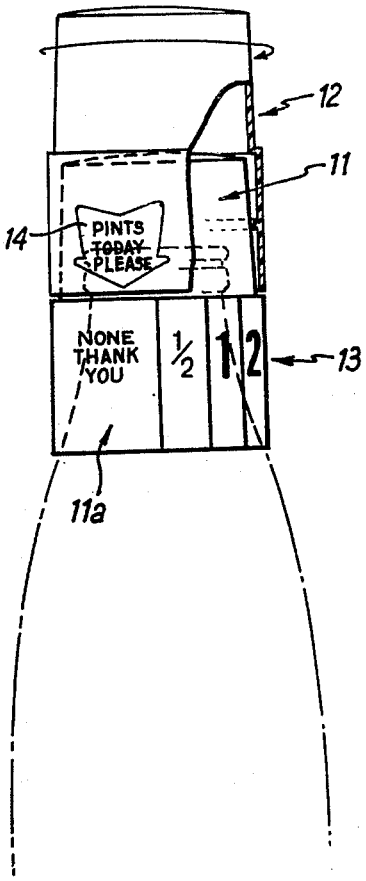
Figure 2:
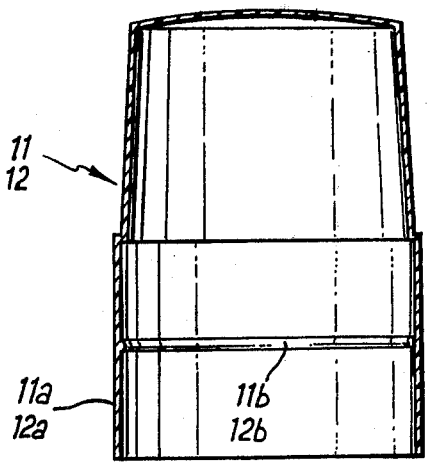

The invention will now be described further, by way of example only, with reference to the accompanying drawing illustrating one embodiment thereof and in which:

FIG. 1 is a broken-away front elevation of the device of the invention as applied to a milk bottle; and FIG. 2 is an axial section, drawn to a larger scale, of one of the sleeve-like members of the device.

Referring now to the drawing, an indicator device for use with milk bottles as a means of indicating customer requirements comprises similar, cooperating generally conical cups 11, 12 arranged in telescoped coaxial disposition, a scale 13 at the exposed outer surface 11*a* of the innermost (and intended lowermost) cup and extending in the peripheral direction thereof, and a pointer 14 at the outer surface of the outermost (and intended lowermost) cup and adjacent to the scale 13 for cooperation therewith.

Whilst each cup 11, 12 is of generally conical form, both inner and outer surfaces are of stepped configuration, the outer surface of the larger diameter port, or skirt 11*a*, 12*a* being cylindrical, the axial extent of such cylindrical part being somewhat less than one half of the full axial extent of the cup. A peripheral rib 11*b*, 12*b* is provided internally of the larger diameter part 11*a*, 12*a* of each cup.

In use, the device is applied to the top of a milk bottle, in the manner shown in FIG. 1 of the drawing, and the relative angular disposition of the two cups is adjusted to bring the pointer 14 into register with that one of the legends of the scale 13 indicative of the supply required.

The cups 11, 12 are conveniently moulded from a synthetic plastics material, although a variety of other materials may be used, the surface engagement of the two inter- engaged cups, allied to the frictional resistance to relative motion therebetween, sufficing ordinarily to maintain such cups in a selected relative angular disposition.

The two cups are readily separable, and thus, in the event that more than one bottle of milk is supplied, the dairyman can separate the cups and place one on each of two bottles, thereby to protect the metal bottle tops from the attention of birds, such facility representing the further function of the device before referred to.

The surface of the outermost or of both of the cups can be used as a carrier for advertising matter, if desired.

The invention is not restricted to the exact features of the embodiment disclosed, since alternatives will readily present themselves to one skilled in the art. Thus, for example, instead of the outer cup 12, a simple band may be rotatably mounted on the inner cup 11, the band being captively applied to the cup, or not, as preferred.

In another arrangement, a slider is captively arranged on the cup for cooperation with a scale mounted on or applied to the cup, the slider being movably axially or peripherally of the cup, and the scale being correspondingly disposed, as preferred.

In a still further arrangement, the cup is replaced by an open-ended sleeve, of conical or other form, intended to seat on the neck of the bottle, the dimensions of the sleeve in relation to those of the bottle conveniently being such that the upper end thereof, when the device is in use, will be so spaced from the bottle top that such top is out of reach of any bird standing on the lip of the sleeve.

In the particular embodiment illustrated, or in others of the various modified structures referred to, the two elements of the indicator means may be interchanged and, thus for example the arrow may be on the inner cup and the scale about the periphery of the outer cup.

It is to be understood that in some instances it may be found desirable to provide sleeve or cou-shaped members additional to the two of the specific embodiment disclosed.

Whilst it is preferred that the outer surface of the larger diameter part of the cup is of cylindrical form, thereby to facilitate the application of the pointer and legends, the invention is not restricted to this feature, nor is it restricted to sleeve-like members of stepped configuration.

What we claim is:

1. A tradesmans indicator comprising:

a pair of substantially identical, separable, hollow, cup members, each cup member having a closure at one end, an opening at the other end, and a side wall with a truncated conical portion proximate said closure end and a skirt portion proximate said open end;

the truncated conical closed end portion of one said member nesting within the skirt portion at the open end of the other member;

said members being rotatable one within the other to selected angular positions when nested;

and the exposed outer surfaces of said members having cooperable indicia thereon for indicating a message to a tradesman as to reorders.

2. A tradesman indicator as specified in claim 1 wherein:

the skirt portion of the side wall of each said member is hollow cylindrical in configuration.

3. A tradesman indicator as specified in claim 2 wherein:

the skirt portion of the side wall of each said member is separated from the truncated conical portion thereof by a step, said step seating the skirt of the next uppermost cup member.

4. A tradesman indicator as specified in claim 1 wherein:

said cooperable indicia on the exposed outer surfaces of said members comprises a scale on one said rotatable member and a pointer on the other said member.

5. In combination:

a milk bottle having a neck;

and a tradesman indicator for ordering further quantities of dairy products, said indicator comprising;

a pair of inverted, cup members, each having a closed upper end, an open lower end and at least a partially tapered side wall, the lowermost said member being nested within the open end of the uppermost said member to about half the height thereof, and cooperable indicator means on the exposed lower, puter surfaces of the side walls of said members, whereby said members may be rotated around their respective central axes to indicate an order, and may be separated in an axial direction to each form a cover for the neck of a milk bottle.

6. An indicator device, primarily for use in connection with milk bottles as a means for ordering further quantities thereof comprising;

a first sleeve-like member adapted and arranged for telescoping engagement with a bottle top;

a second sleeve-like member telescopably engageable with said first sleeve-like member and in coaxial relationship therewith, said second sleeve-like member being movably mounted thereon and freely removable therefrom;

cooperable indicator means on said first and second sleeve-like members for indicating a selected one of a plurality of legends provided by said indicator means;

and a peripheral rib at the internal surface of said second sleeve-like member, arranged coaxially with the axis of said second sleeve-like member for engagement with the outer surface of said first sleeve-like member.

7. An indicator device, primarily for use in connection with milk bottles as a means for ordering further quantities thereof comprising;

a first sleeve-like member adapted and arranged for telescoping engagement with a bottle top;

a second sleeve-like member telescopable engageable with said first sleeve-like member and in coaxial relationship therewith, said second sleeve-like member being movably mounted thereon and freely removable therefrom; and cooperable indicator means on said first and second sleeve-like member for indicating a selected one of a plurality of legends provided by said indicator means;

each said sleeve-like member being of stepped external configuration and being of greater outside dimension at the intended lower end thereof.

8. An indicator device as specified in claim 7 wherein:

said second sleeve-like member is freely removable from said first sleeve-like member.

9. An indicator device as specified in claim 7 wherein:

the intended upper end of each said sleeve-like member is closed.

10. An indicator device, primarily for use in connection with milk bottles as a means for ordering further quantities thereof comprising;

a first sleeve-like member adopted and arranged for telescoping engagement with a bottle top;

a second sleeve-like member telescopably engageable with said first sleeve-like member and in coaxial relationship therewith, said second sleeve-like member being movably mounted thereon and freely removable therefrom;

cooperable indicator means on said first and second sleeve-like members for indicating a selected one of a plurality of legends provided by said indicator means;

each said sleeve-like member being of truncated conical form in the intended upper end thereof.

* * * * *